US006318441B1

(12) United States Patent
Love et al.

(10) Patent No.: US 6,318,441 B1
(45) Date of Patent: Nov. 20, 2001

(54) WINDOW BLINDS

(75) Inventors: James Love, Calgary (CA); Victor Ermoli, Savanagh, GA (US)

(73) Assignee: University Technologies International Inc. (CA)

( * ) Notice: Subject to any disclaimer, the term of this patent is extended or adjusted under 35 U.S.C. 154(b) by 0 days.

(21) Appl. No.: 09/467,771

(22) Filed: Dec. 20, 1999

Related U.S. Application Data

(60) Provisional application No. 60/112,949, filed on Dec. 18, 1998.

(51) Int. Cl.[7] ..... E06B 3/20

(52) U.S. Cl. ..... 160/236; 160/178.1 R

(58) Field of Search ..... 160/236, 178.1 R, 160/176.1 R, 168.1 R, 179

(56) References Cited

U.S. PATENT DOCUMENTS

| | | | | |
|---|---|---|---|---|
| 2,146,816 | * | 2/1939 | Grassby, Jr. | 160/236 |
| 2,155,985 | * | 4/1939 | Waterman . | |
| 3,971,427 | * | 7/1976 | Coldewey et al. | 160/236 |
| 4,292,763 | | 10/1981 | Barnes et al. . | |
| 4,557,565 | | 12/1985 | Ruck et al. . | |
| 4,572,267 | | 2/1986 | Stein et al. . | |
| 4,621,672 | | 11/1986 | Hsu et al. . | |
| 4,799,526 | | 1/1989 | Reeves . | |
| 5,119,868 | | 6/1992 | Werner . | |
| 5,205,335 | | 4/1993 | Horton et al. . | |
| 5,209,282 | * | 5/1993 | Franco et al. . | |
| 5,402,840 | | 4/1995 | Jortner et al. . | |
| 5,423,367 | | 6/1995 | Kataoka et al. . | |
| 5,485,874 | | 1/1996 | Whitmore . | |
| 5,657,806 | * | 8/1997 | Hung | 160/236 |
| 6,006,816 | * | 12/1999 | Biro et al. . | |

FOREIGN PATENT DOCUMENTS

| | | | | |
|---|---|---|---|---|
| 1220085 | * | 5/1960 | (FR) | 160/236 |

* cited by examiner

*Primary Examiner*—Blair M. Johnson
(74) *Attorney, Agent, or Firm*—Bennett Jones LLP

(57) ABSTRACT

A window covering system includes a plurality of horizontal slats which are tiltable to control entry of light. The slats include a light processing section which may be a transparent or translucent plastic and an opaque section which may be aluminum. In cross-section, the slats have a complex curvature which processes and diffuses light into the interior while preventing direct light beam penetration to the interior.

10 Claims, 13 Drawing Sheets

WINDOW BLINDS

CROSS-REFERENCE TO RELATED APPLICATION

This application claims the priority benefit of U.S. Provisional Application No. 60/112,949 filed on Dec. 18, 1998 and entitled Horizontal Dual-Element Window Blinds, which application is incorporated herein by reference in its entirety.

FIELD OF THE INVENTION

The present invention relates to window covering systems and in particular to horizontal window blinds.

BACKGROUND OF THE INVENTION

Window covering systems exist primarily to shield interior spaces from direct sunlight and to prevent others from viewing inside through the window. Conventional systems such as venetian blinds, drapes and shades may block direct sunlight effectively but do not permit diffuse light to enter for illumination purposes when they are closed. It is known that occupants tend to set conventional venetian blinds in a closed position and seldom adjust them.

Many examples of prior art window covering systems exist which attempt to block direct sunlight while allowing natural illumination. It is known to use a slat which is semi-transparent as a result of numerous pores being punched into the slat, known in the art as a "punched slat". In U.S. Pat. No. 5,423,367 issued to Kataoka et al. on Jun. 13, 1995, a partially punched slat is disclosed. In this patent, the slats are angle shaped and formed of a first punched section and a second non-light transmitting section wherein the two sections are joined at an angle. Thus, if the slats are rotated in one direction, the blind will appear semi-transparent and if they are rotated in another direction, the blind will appear closed. This system still requires user adjustment to provide interior illumination and cannot provide good illumination without compromising privacy and allowing direct sunlight to enter the room.

A similar approach is taken in U.S. Pat. No. 4,799,526 issued to Reeves. In this patent, the slat is partially or completely made of a transparent plastic such as a polycarbonate. This slat may be adjusted such that the blind is transparent or completely blocking if the slat also comprises an opaque portion. Again, these slats cannot provide illumination without compomising privacy or allowing direct sunlight to enter.

Therefore, there is a need in the art for a window covering system which permits diffuse light to enter and illuminate a room while blocking direct sunlight from entering the room and maintaining a privacy screen when desired.

SUMMARY OF THE INVENTION

In general terms, the invention comprises a window covering system which includes a plurality of slats which may be adjusted for tilt to control the entry and processing of light into the interior of a room.

In one aspect of the invention, the invention comprises a slat for use in a venetian blind window covering system, wherein said slat comprises:

(a) an interior longitudinal portion comprising an opaque material;

(b) an exterior longitudinal portion comprising a light processing material and which is curved around a longitudinal axis such that an upper surface of the exterior portion is convex;

wherein the interior portion and the exterior portion are joined lengthwise to form the slat.

In one embodiment, the exterior portion may comprise a plurality of corrugations. The interior portion may comprise a shield portion and a reflecting portion. The shield portion may comprise a first shield portion and an intermediate shield portion wherein the first shield portion and the reflecting portion are approximately parallel and not co-planar and are joined by the intermediate shield portion. The intermediate shield portion may be at a substantially right angle to both the first shield portion and the reflecting portion.

In one embodiment, the exterior portion joins the first shield portion at an angle not more than about 35° and preferably about 25°.

In one embodiment, the exterior portion may be comprised of a transparent or translucent plastic, which may be an acrylic. The interior portion may be a plastic or a metal and may be aluminum.

In one embodiment, the slats may be spaced apart such that when the slats are partially open, the interior edge of the interior portion of a first slat is horizontally level with the exterior edge of the exterior portion of the slat immediately below or above the first slat.

In another aspect of the invention, the invention comprises a plurality of slats which are held in a parallel spaced apart relationship by means for supporting the slats.

In one embodiment, the invention further comprises:

(a) a head box and side frames depending from the ends of the head box;

(b) supporting cords depending vertically from the head box;

(c) wherein each slat is positioned such that the exterior portion faces the exterior and the interior portion faces the interior; and (d) means for adjusting the angle of all or a group of the slats;

wherein an upper group of slats are fixed are at a fixed angle so as to prevent direct beam transmission of sunlight into the interior but may still permit diffused sunlight to enter and a lower group of slats are adjustable by the angle adjusting means.

In another aspect of the invention, the invention comprises a window covering system having a head box and exterior and interior support cords depending therefrom comprising:

(a) a plurality of horizontal slats each having an exterior strip with an exterior edge facing the window and an interior strip with a interior edge facing inwards;

(a) a plurality of exterior fasteners attached to the exterior strips wherein at least one exterior support cord is fixed to the slats by the exterior fasteners such that the slats are supported and spaced apart;

(b) a plurality of interior fasteners attached to the interior strips wherein at least one interior support cord is fixed to the slats by the interior fasteners such that the slats are supported and spaced apart; and (c) means for raising or lowering the interior support cords while simultaneously moving the exterior support cord in the opposite direction, wherein said means are associated with the head box.

In one embodiment, the support cords do not pass through an opening in any slat such that an individual slat may be removed from the system by disconnecting the exterior and interior fasteners attached to that slat.

BRIEF DESCRIPTION OF THE DRAWINGS

Aspects and embodiments of the invention will now be described by way of an exemplary embodiment with reference to the accompanying simplified, diagrammatic, not-to-scale drawings. In the drawings.

DETAILED DESCRIPTION OF THE INVENTION

Figure 1:
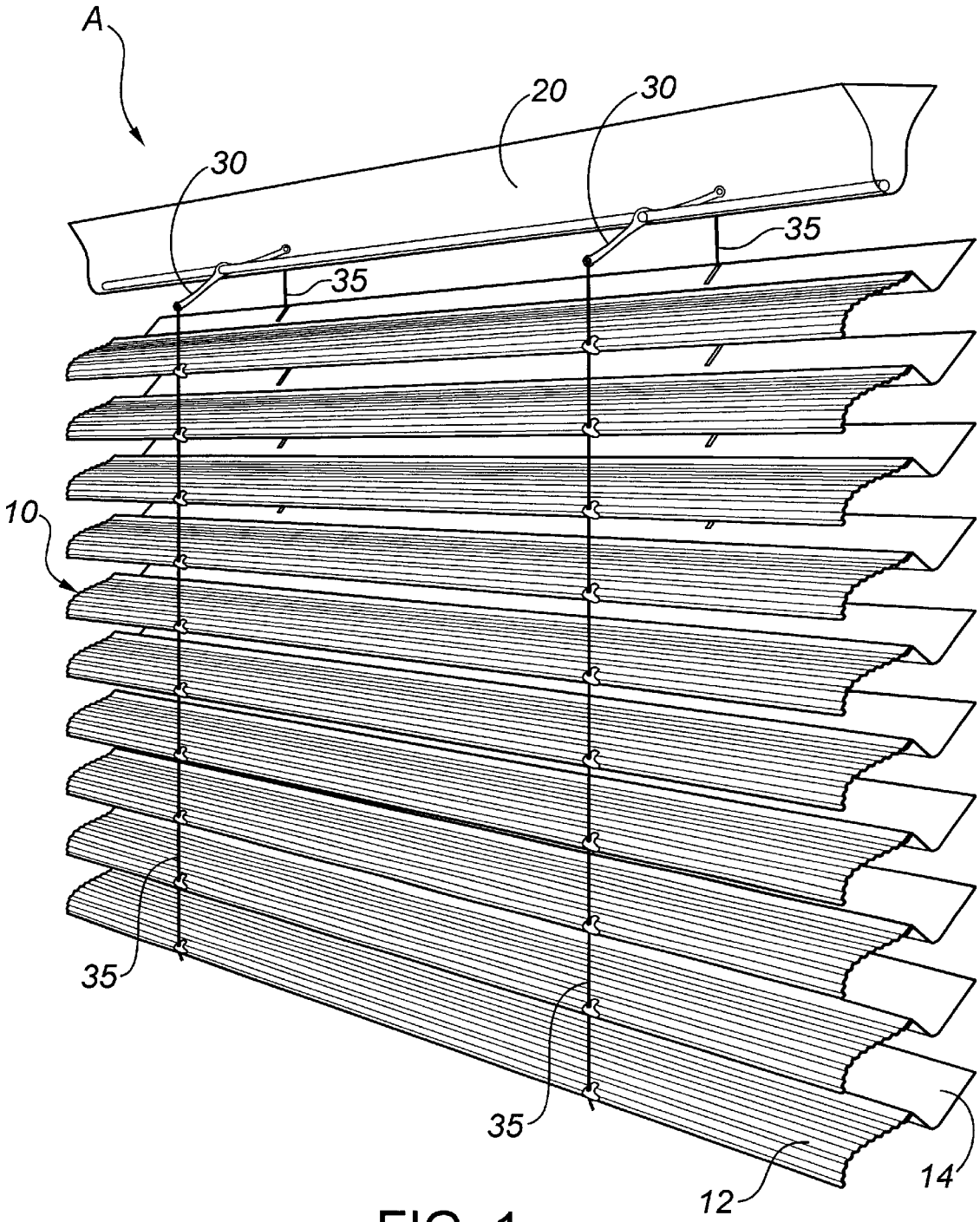
FIG. 1 is a view of a window covering system of the present invention from an exterior, oblique perspective.

The window covering system (A) according to the Figures comprises a window covering slat (10) having a light processing exterior portion (12) and an opaque interior portion (14). The system (A) is intended to be mounted to the interior frame of windows such that the light processing portion or exterior portion (12) is immediately adjacent the window while the opaque portion (14) or interior portion faces the interior of the room. The system (A) further comprises a head box (20), side frames (25), adjusting rockers (30), support and adjusting cords (35) as well as a raise/lower cord (50). As used herein, "light processing" refers to a materials ability to transmit and diffuse visible light and includes the properties of translucency and transparency. As used herein, "translucent" describes a material that transmits an appreciable amount of visible light and diffuses visible light. As used herein, "transparent" describes a material that transmits sufficient visible light with little distortion or beam deviation so as to permit perception of objects through the material. Generally speaking, a transparent material will have a beam deviation angle of less than about 1%. An otherwise transparent material may appear milky or hazy if the angle of deviation is greater than about 2.5%. As used herein, "opaque" describes a material which does not transmit any appreciable amount of visible light.

The slats (10) of the present invention are described herein as being part of a horizontal window blind system. It will be appreciated by one skilled in the art that the teachings of the present invention may apply to vertical window blinds and that the slats described and claimed herein may be used in a vertical blind system.

The light processing portion (12) of the slat (10) may be made of any suitable clear material, however, it is preferably fashioned from a translucent or transparent material such as a plastic. In the preferred embodiment, the light processing portion (12) is fashioned from acrylic. The opaque portion (14) may be made of any non-light transmitting material however, it is preferably fashioned from a metal such as aluminum, although colored or opaque plastics may also be used. Aluminum is preferred due to its lightweight and relative strength. It may also be easily fabricated and painted.

Figure 2A:
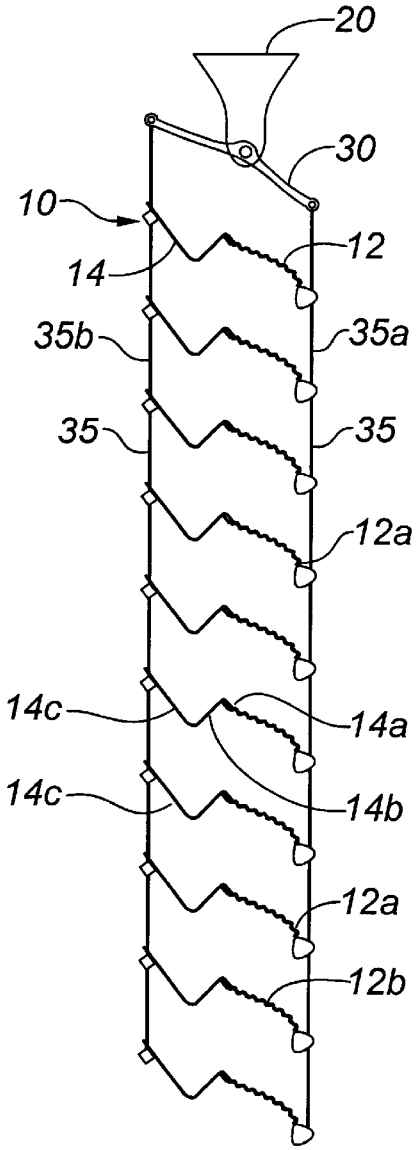
FIGS. 2A., 2B and 2C are cross-sectional depictions of the system of FIG. 1 in a semi-opened, closed and fully opened state respectively.
Figure 2B:
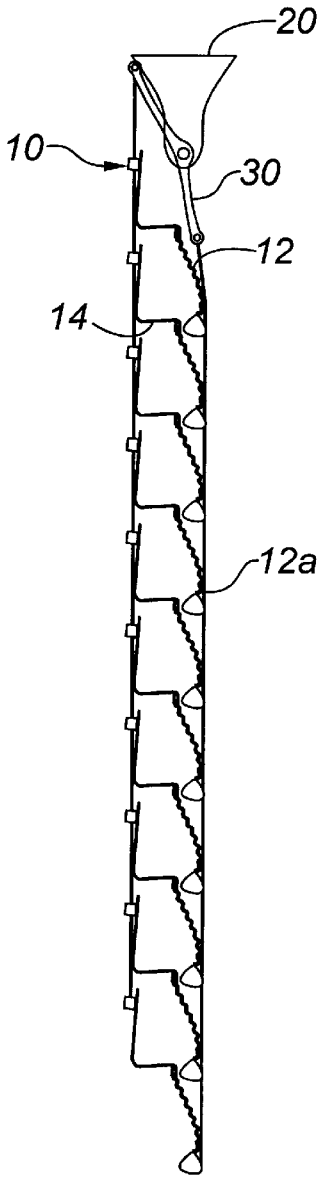
FIG. 2D is a cross-sectional depiction of two slats open at about 20°.
Figure 2C:
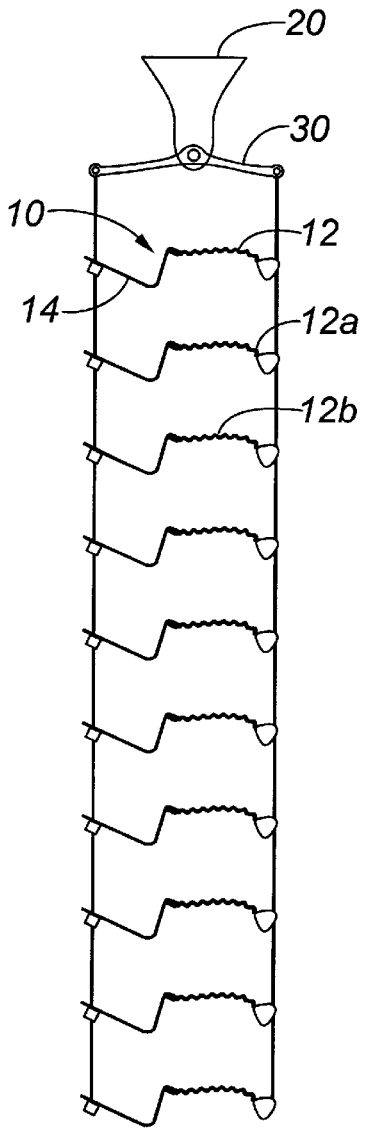

In a preferred embodiment, the slats (10) have a functional cross-sectional profile which is illustrated in the Figures and particularly in FIGS. 2A to D. The slat (10) design processes light and diffuses it upward into the interior of the room while blocking any direct sunlight or direct reflections from entering the room. The light processing portion (12) is slightly curved such that the upper surface of the light processing portion is slightly convex and the exterior edge (12*a*) is sloped downward when the slat is in a horizontal, completely open position as is shown in FIG. 2C. In the specific embodiment shown in FIG. 2D, the curve is introduced approximately two-thirds towards the exterior edge (12*a*) and represents a curve of about 25° as indicated by dashed lines L1 and L2. As an additional preferred feature, the light processing portion (12*a*) is rippled with a plurality of corrugations (12*b*). In a preferred embodiment, the corrugations have an amplitude of approximately 4% of the width of the light processing portion and a width such that there are about 8 corrugations across the light processing portion.

Figure 2D:
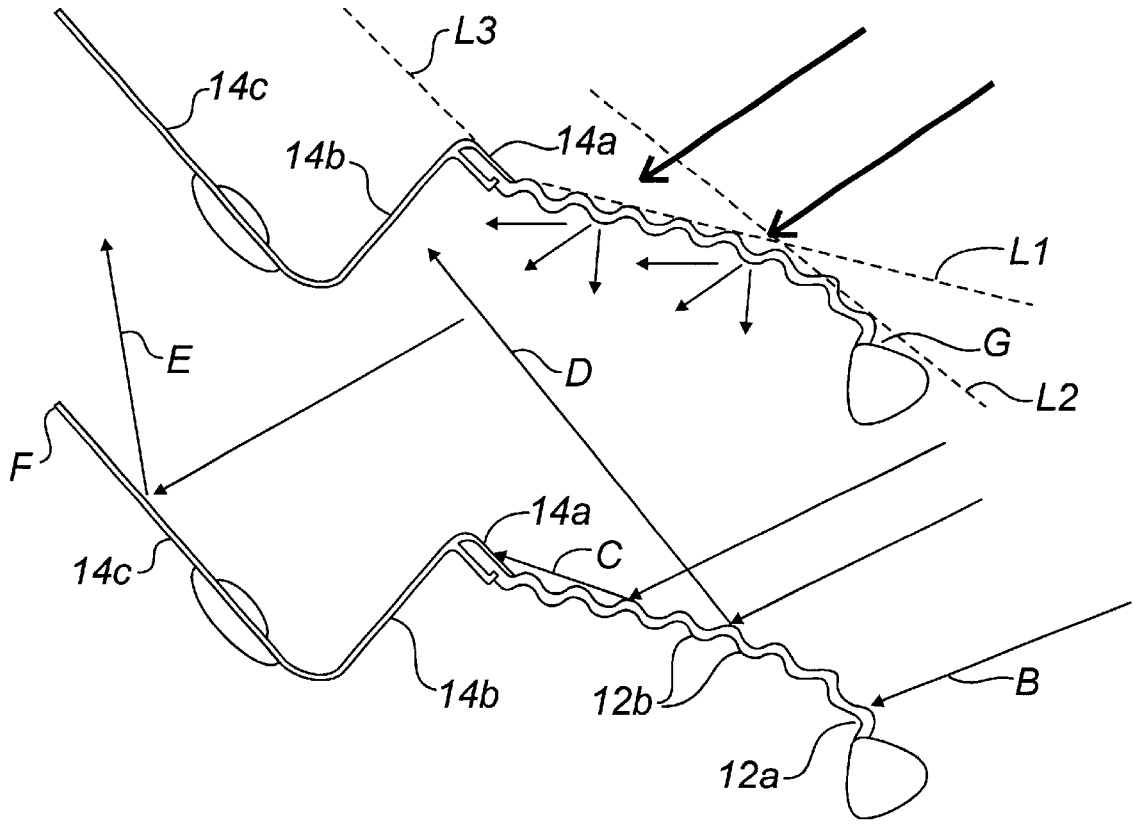
Figure 3:
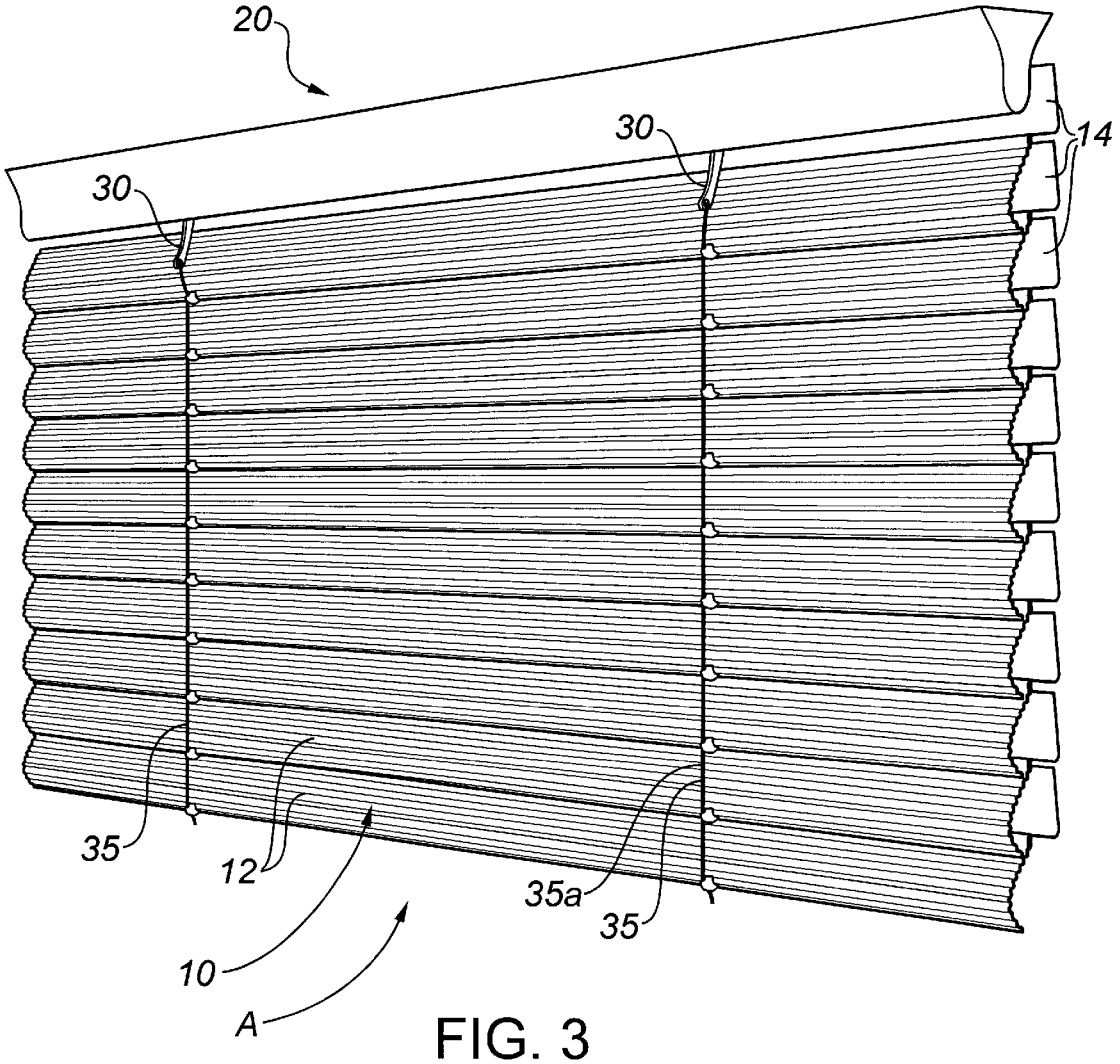
FIG. 3 is a view from the exterior of the system in its closed state.
Figure 4:
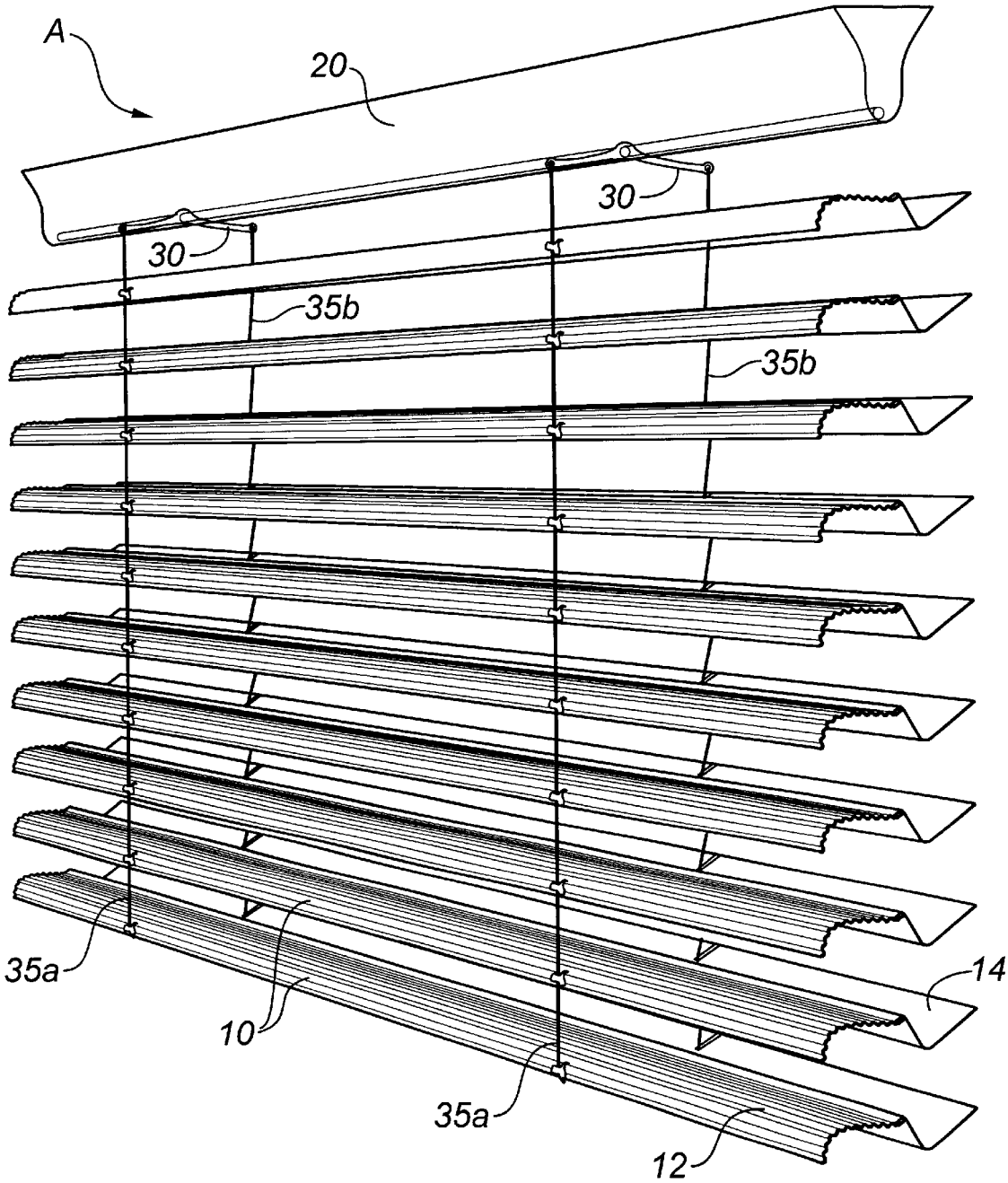
FIG. 4 is a view from the exterior of the system in its fully open state.
Figure 5:
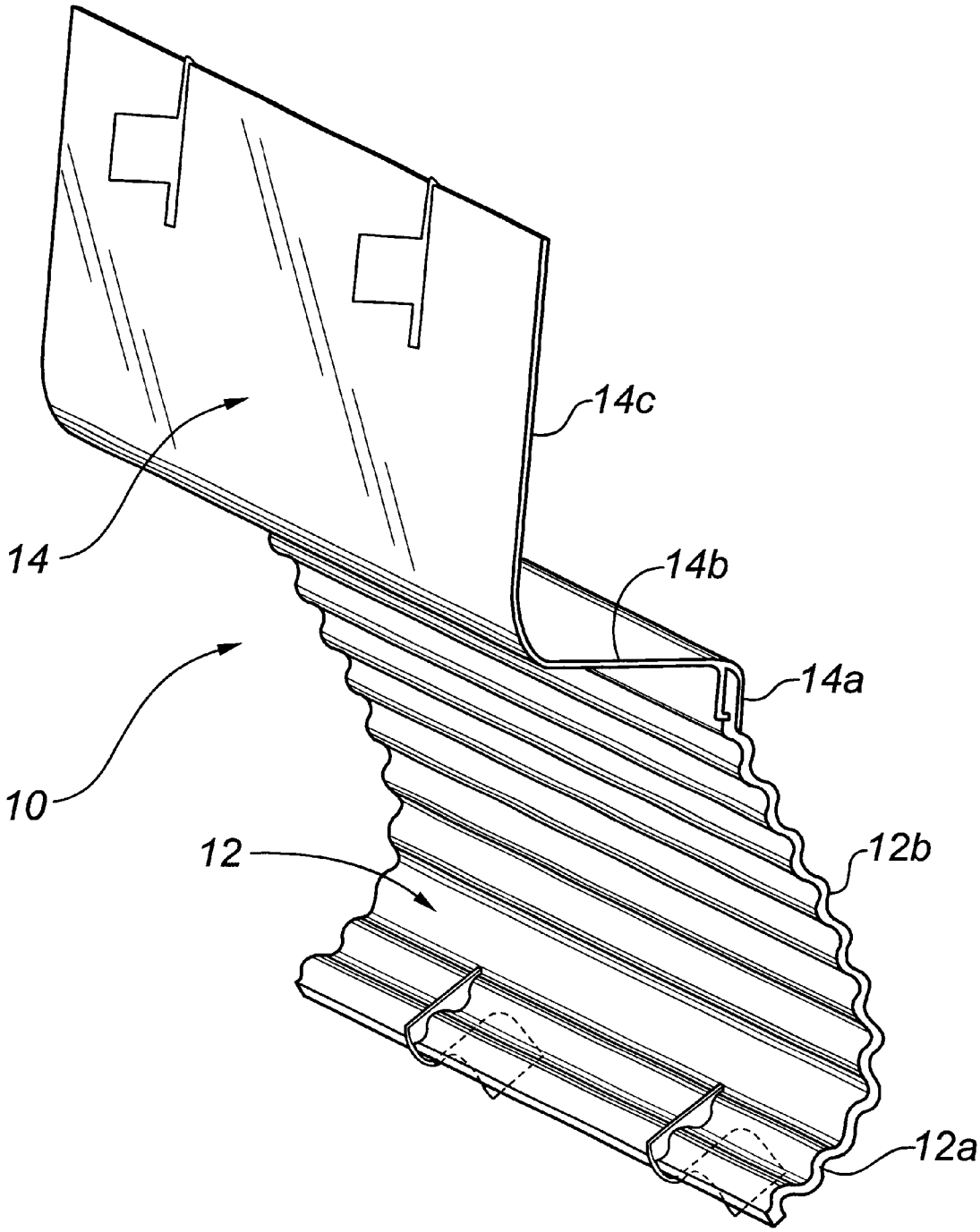
FIG. 5 is a cross-sectional detail of a preferred embodiment of a slat.

The exterior edge (12*a*) of the light processing portion (12) is intended to process low-angle sunlight such as that depicted by line B in FIG. 2D. The corrugations (12*b*) serves to increase the surface area of the slat (10), thereby increasing the light processing area of the light processing portion (12). The corrugations also serve to increase the longitudinal stiffness of the slat (10) which permits the use of fewer supporting cords, as is described below. As shown in FIG. 2D, light which directly impinges on the light processing portion (12) is scattered by the corrugations (12*b*) and the light processing properties of the light processing material.

In one embodiment, the opaque portion (14) comprises a first shield portion (14*a*), an intermediate shield portion (14*b*) and a reflecting tail portion (14*c*). When the slat (10) is horizontal, open position as is shown in FIG. 2C, the first shield (14*a*) is tilted slightly downwards, the intermediate shield (14*b*) is angled approximately 90 degrees from the first shield while the reflecting tail (14*c*) is approximately parallel to the first shield and is angled slightly upward into the interior of the room.

In one embodiment, the first shield (14*a*) joins the light processing section (12) at an angle of not more than about 35° and preferably about 25° as indicated by the angle between L1 and L3 in FIG. 2D. The first shield (14*a*) blocks low angle reflections (C) coming from the upper surface of the light processing portion. The intermediate shield (14*b*) also blocks reflections (D) from the upper surface of the light processing portion as well as pinpoint light concentrations which tend to result when acrylic panels are exposed to direct sunlight. In one embodiment, the upper surface of the reflecting tail (14*c*) is preferably painted or otherwise coloured a light reflective colour while the bottom surface is preferably a darker, non-reflective colour, such as gray. The upper surface of the reflecting tail is intended to reflect light upwards (E) towards the ceiling in the room. Because the bottom surface is the predominant visible surface in the room when the slats are closed or partially closed, it may be preferable to paint them to match interior colour schemes or to paint them with a lighter colour. Although a lighter colour may be more reflective, there would be less luminance variation, which may be more visually satisfactory.

In the specific embodiment illustrated in FIG. 2D, the spacing between adjacent slats (10) and the dimensions of the slat and the various portions of the slat has been configured such that when the slats are open at about 20°, significant amounts of light are processed into the interior. However, a direct horizontal line of sight into the interior is not possible because the interior edge (F) of the slat (10) is approximately level with the exterior edge (G) of the slat immediately above the first slat.

Figure 6:
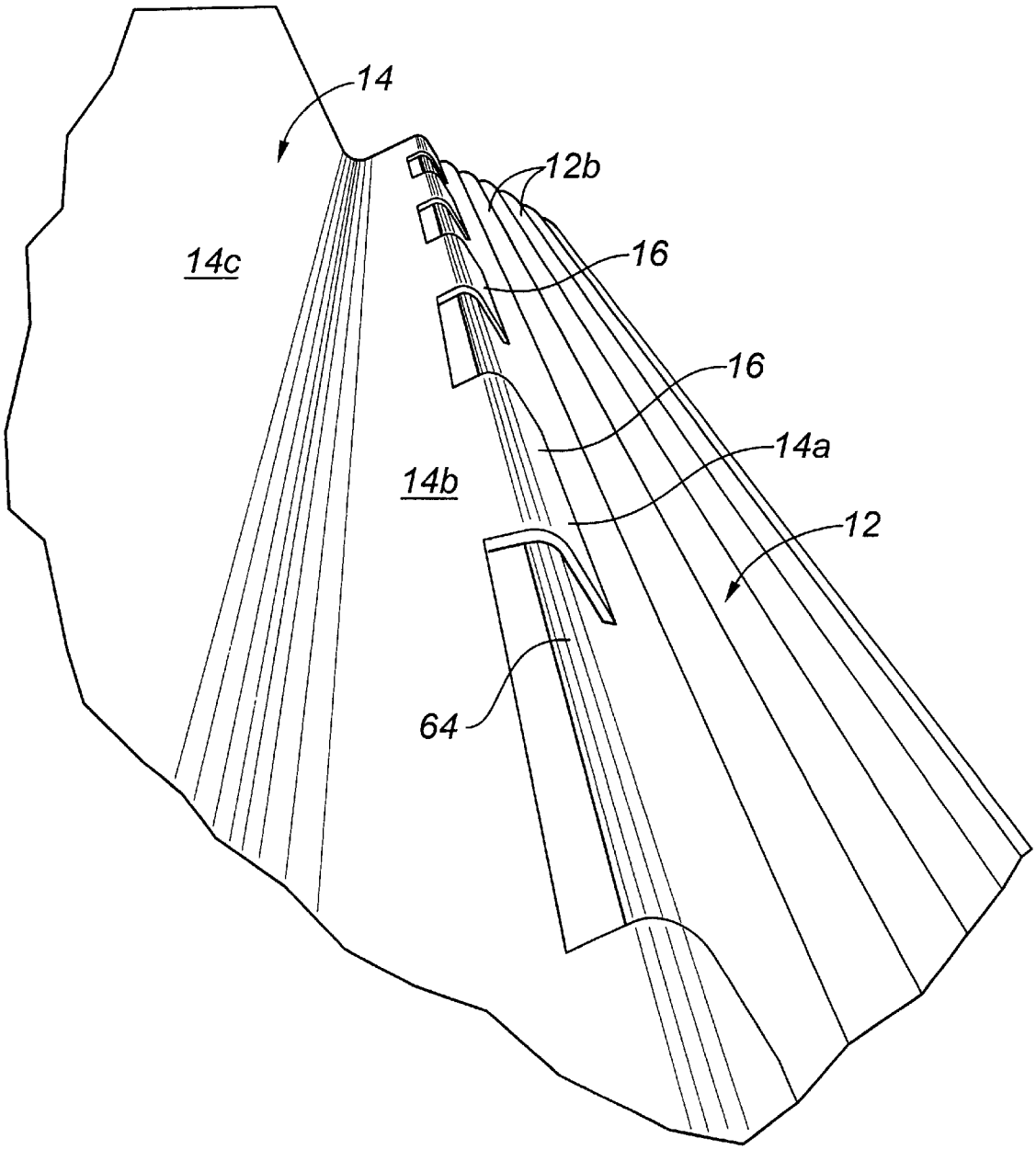
FIG. 6 is a detail of the joining portions of the opaque portion and the light processing portion of the slat.
Figure 6A:
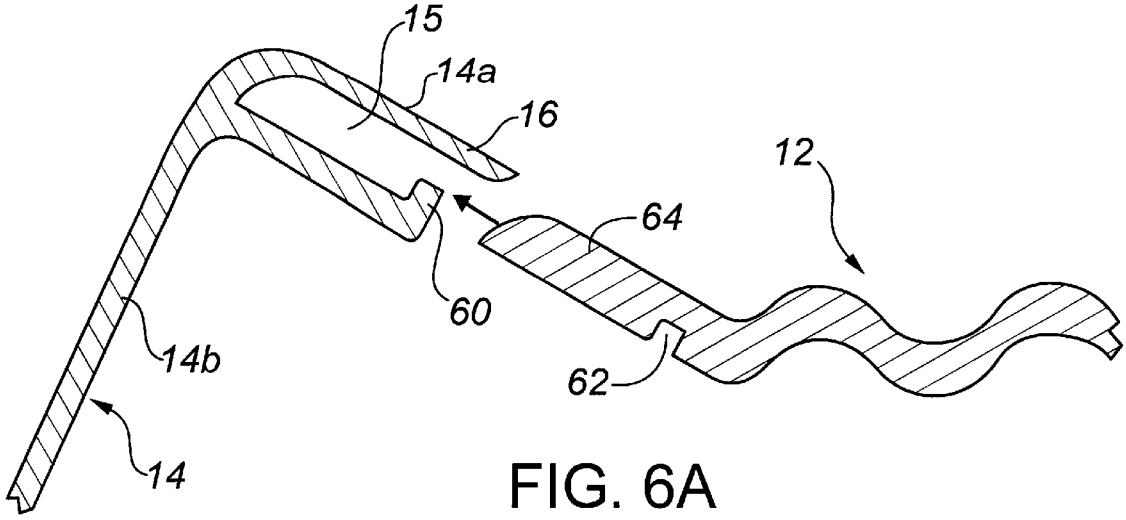
FIGS. 6A and 6B shows a cross-sectional detail of the joining portions.
Figure 6B:
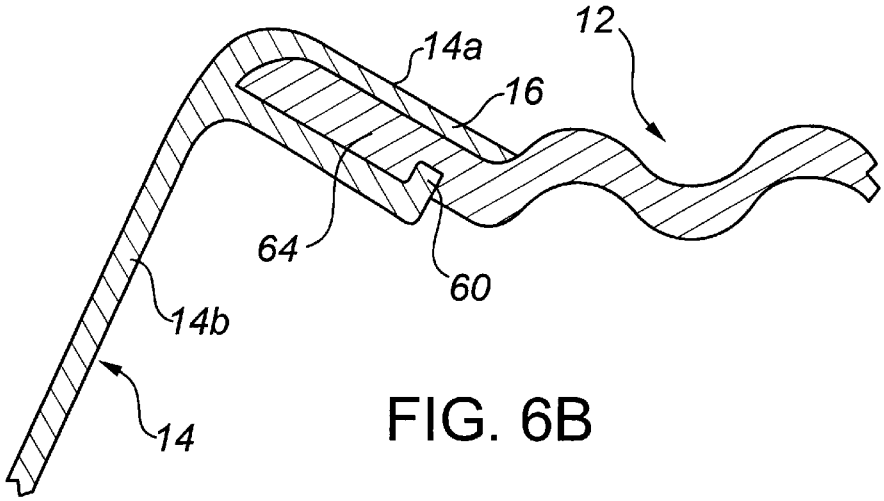

The light processing portion (12) and the opaque portion (14) may be joined by a tongue-and-groove configuration illustrated in FIG. 6A. A locking member (60) forming part of the groove (15) may be provided to mate with locking groove (62) provided in the tongue portion (64) of the opaque portion. Alternatively, or in addition, an adhesive may be used to ensure a permanent bond between the two portions. In a further preferred variation, the groove portion (15) of the opaque portion (14) may be divided into a series of tabs (16) as is shown in FIG. 6. Alternatively, one skilled in the art may conceive of many variations of joining the two portions into one slat, all of which are intended to be encompassed by the claims herein. The specific method of joining the two portions is not intended to be limiting of the invention. It is conceivable that one skilled in the art may fashion a slat of the present invention from a unitary piece of material without the need for joining two separate portions.

Figure 7:
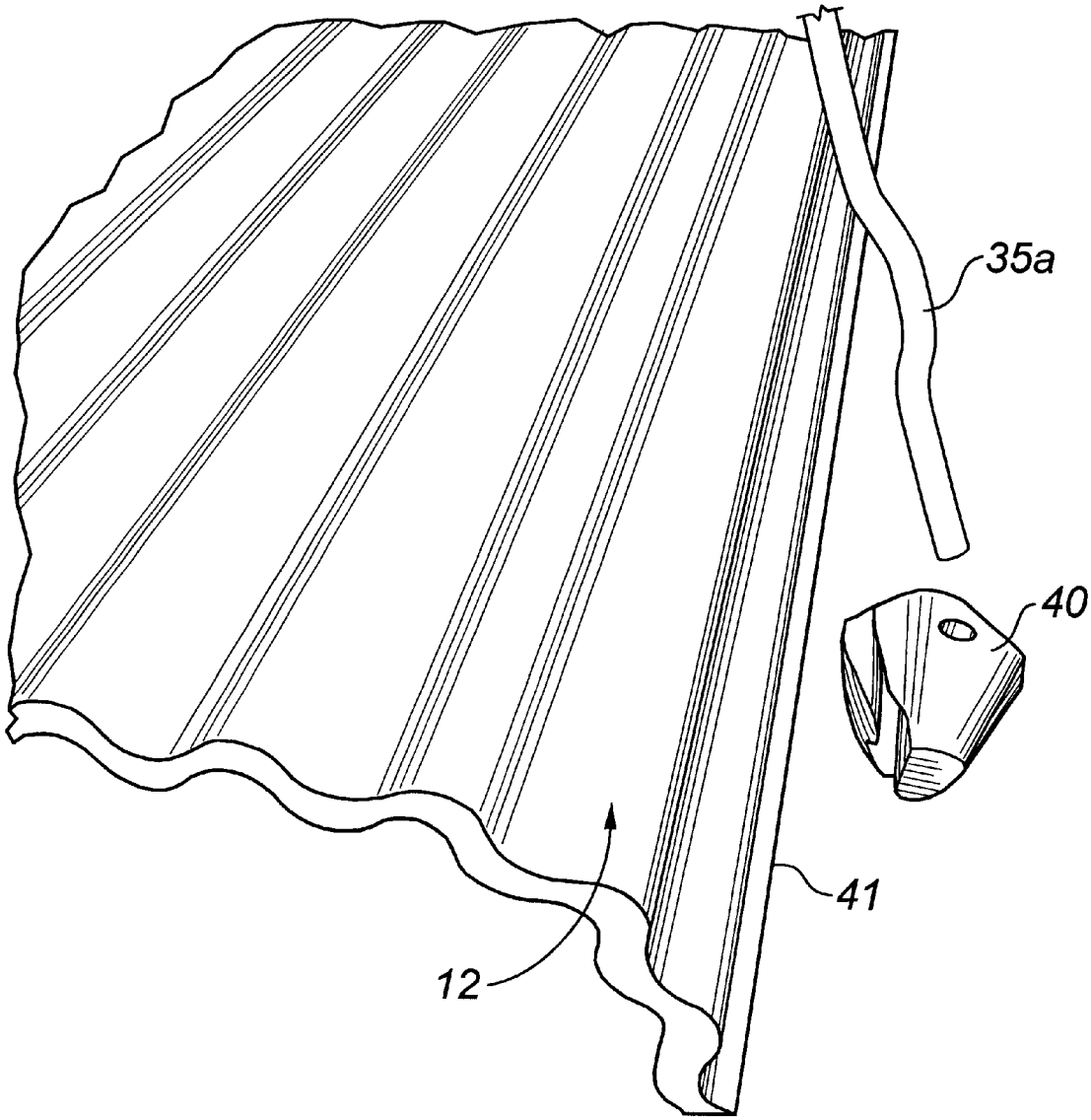
FIG. 7 is a disassembled detail of the anterior fastener and anterior support/adjusting cord.

In one embodiment, the slats (10) may be suspended and spaced apart by two sets of support and adjusting cords (35); a set of exterior cords (35*a*) and a set of interior cords (35*b*). The exterior cords (35*a*) pass through exterior clips (40) which fasten to the exterior edge (41) of the light processing portion of the slats. The cords (35*a*) are firmly held by the clips (40) such the slats are adequately supported and do not slide up and down the cord. FIG. 7 shows the exterior clip (40) together with the exterior cord.

Figure 8:
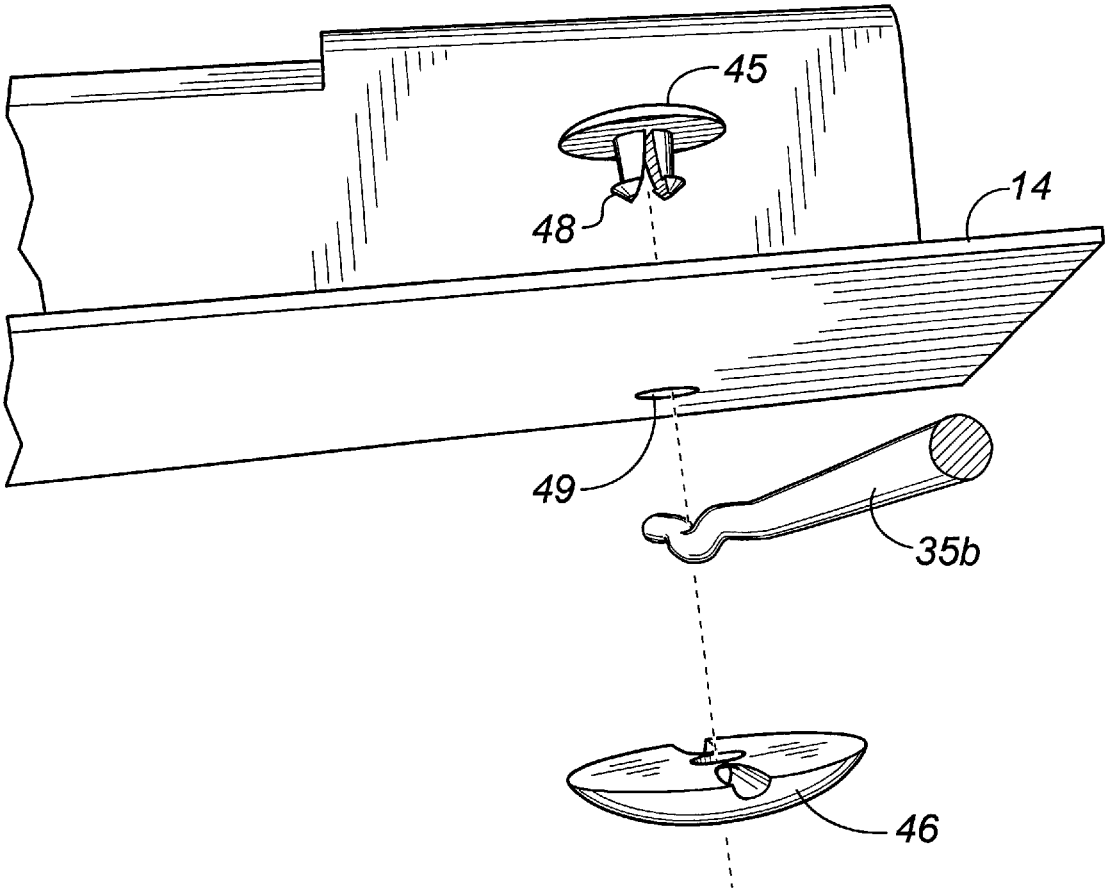
FIG. 8 is a detail of the posterior fastener and posterior support/adjusting cord.

The opaque portion (14) of the slats may be affixed to the interior cords (35*b*) by means of a two-piece fastener (45, 46), as illustrated in FIG. 8. The upper piece (45) comprises a split prong (48) which inserts into an opening (49) in the slat and firmly engages or snaps into the bottom piece (46). The cord is placed between the prongs (48) and the bottom piece (46) is snapped into place. The cord and slat are held together by the friction fit of the fastener (45, 46) and the cord.

The interior and exterior cords (35) depend from opposite arms of the adjusting rocker (30) which pivots about a central pivot as is shown in FIGS. 2A, 2B and 2C. As is obvious, moving the rocker in one direction will close the system (A) as is depicted in FIG. 2B by raising the interior cords while lowering the exterior cords. The system may be opened again by returning the rocker to a horizontal position, as is depicted in FIG. 2C.

This configuration of interior and exterior cords (35*a*, 35*b*) permits the removal and replacement of a single slat without dissambling the entire system (A) or cutting the cords.

The particular configuration of cords or other means of opening or closing the slats (10) is not considered essential to the invention. One skilled in the art may conceive of variations which are intended to be encompassed by the claims herein.

Figure 9:
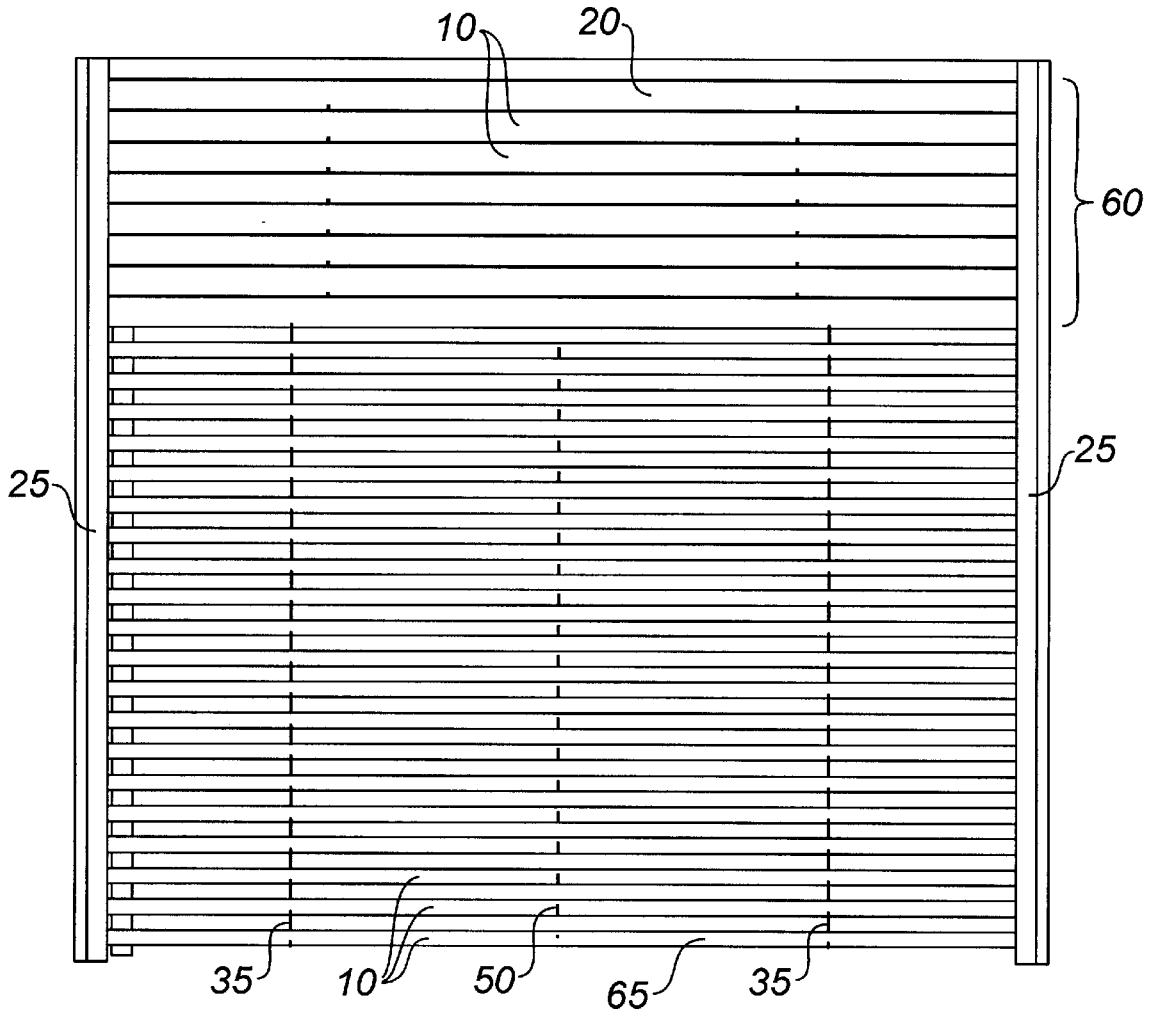
FIG. 9 is a interior view of the system indicating the position of the support/adjusting cords as well as the raise/lower cord.

As is shown in FIG. 9, in one variation, it is preferred to fix the angle of a portion (60) of the slats, preferably an upper portion, to permit the entry of light even when the remaining slats are closed. In one embodiment, up to one third of the slats may be fixed in position in this manner.

In an alternative embodiment, the slats (10) may be raised or lowered in the same fashion as conventional horizontal blinds by a raise/lower cord (50) which freely passes through or around all of slats and is fixed to the bottommost slat (65). Pulling on the raise/lower cord (50) obviously raises the bottommost slat and all of the other slats as a result.

Figure 10:
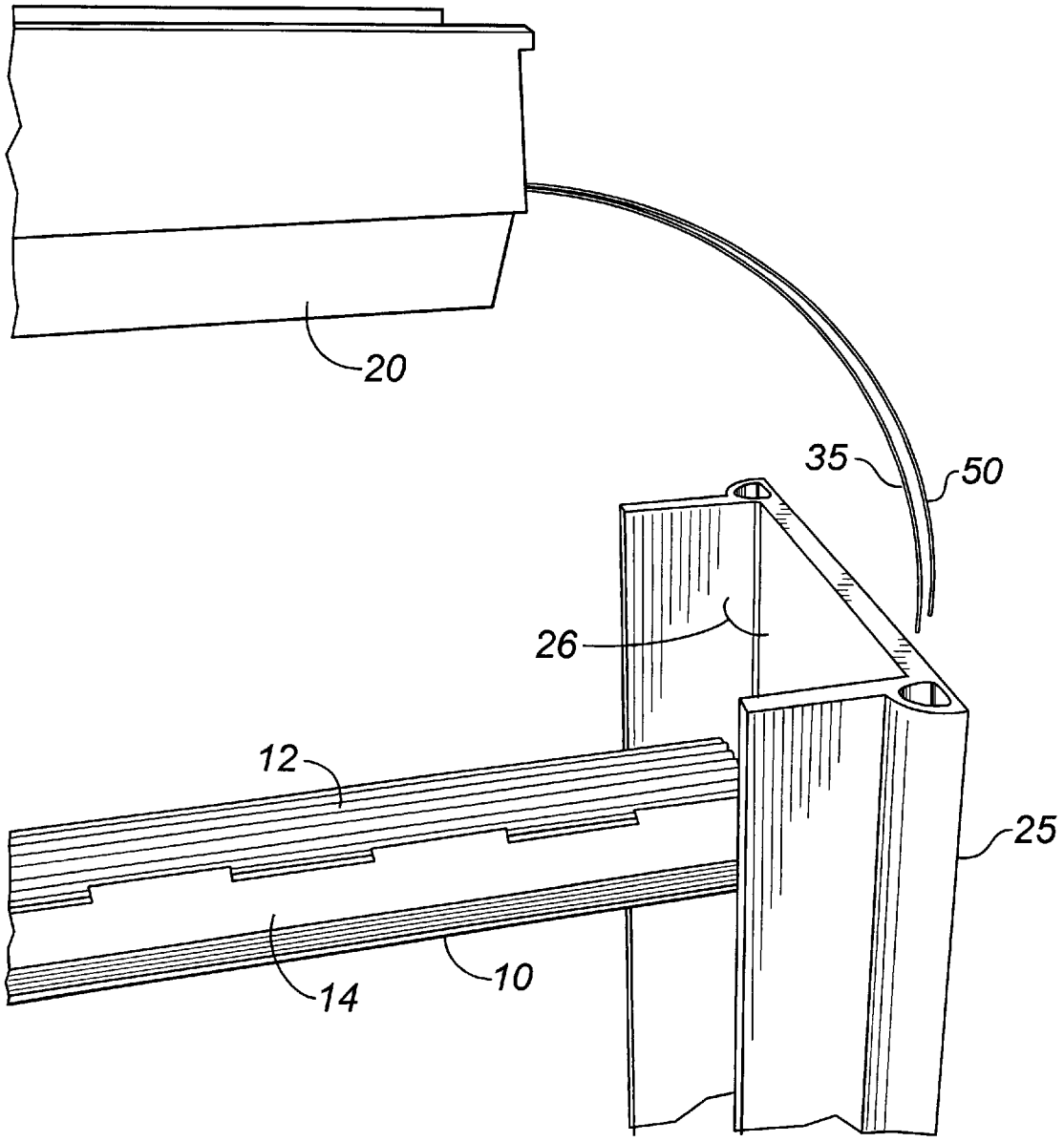
FIG. 10 is a detail of the head box, side frame and cords.
Figure 11:
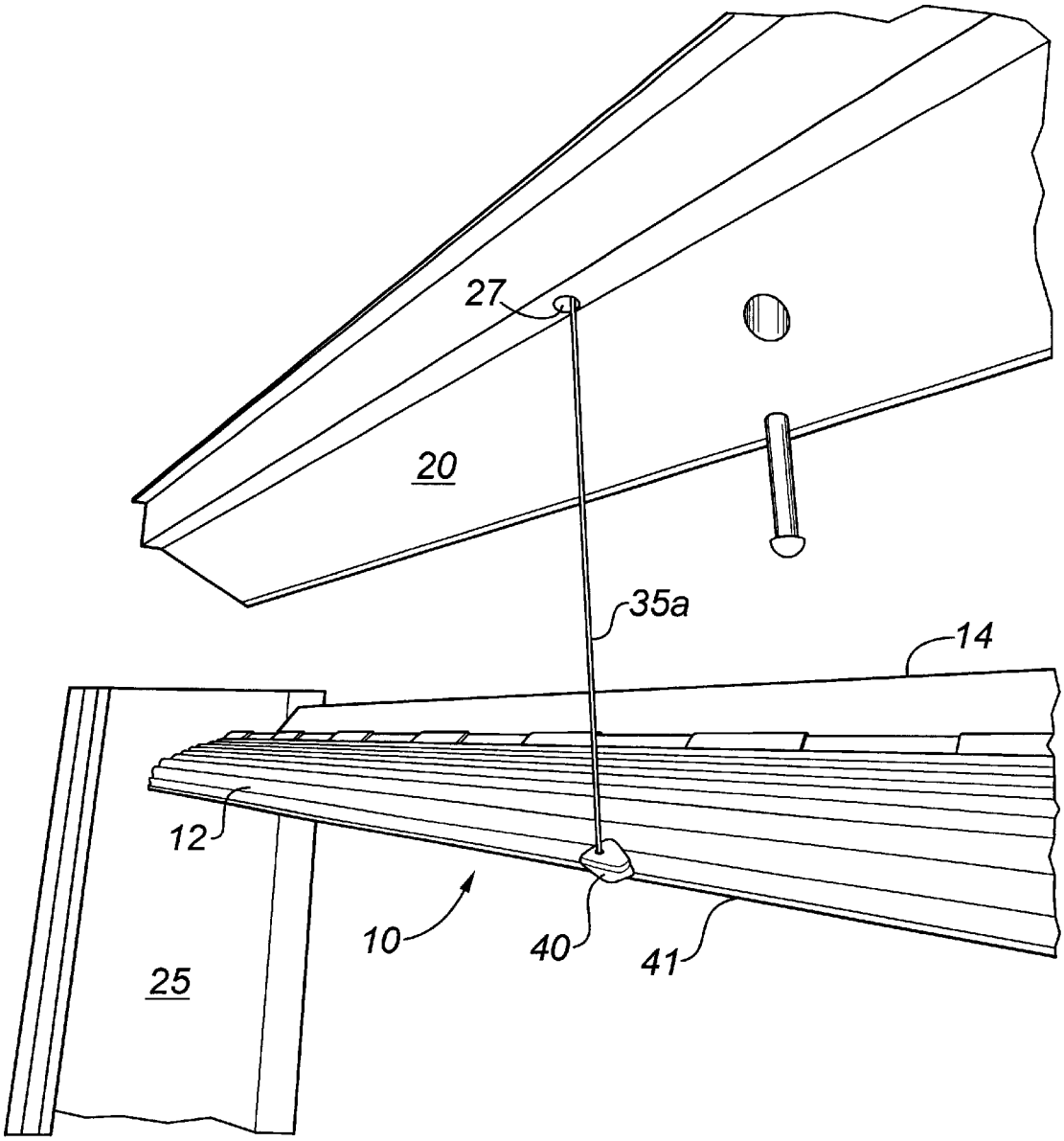
FIG. 11 is a detail of the head box and anterior support/adjusting cord, showing only the first slat.

Referring to FIG. 10, in the preferred embodiment, the side frames (25) define a channel (26) in which the ends of the slats (10) are disposed, thereby preventing the leakage of light around the sides of the system. The head box (20) has channels through which the support and adjusting cords and the raise/lower cord passes out to the side frame where they are accessible to a user for adjustment. Referring to FIG. 11, the support and adjusting cord (35) may pass through an opening (27) in the head box downwardly to the slats.

As will be apparent to those skilled in the art, various modifications, adaptations and variations of the foregoing specific disclosure can be made without departing from the teachings of the present invention.

What is claimed is:

1. A slat for use in a venetian blind window covering system, wherein said slat comprises:

(a) an interior longitudinal portion comprising an opaque material, wherein said interior portion comprises a shield portion and a reflecting portion, wherein said shield portion comprises a first shield portion and an intermediate shield portion wherein the first shield portion and the reflecting portion are approximately parallel and not co-planar and are joined by the intermediate shield portion;

(b) an exterior longitudinal portion comprising a light processing material and which is curved around a longitudinal axis such that an upper surface of the exterior portion is convex;

wherein the interior portion and the exterior portion are joined side-by-side and lengthwise to form the slat.

2. The slat of claim 1 wherein the exterior portion defines a plurality of longitudinal corrugations.

3. The slat of claim 1 wherein an upper surface of the reflecting portion comprises a light reflective color.

4. The slat of claim 1 wherein the intermediate shield portion is at a substantially right angle to both the first shield portion and the reflecting portion.

5. The slat of claim 1 wherein the exterior longitudinal portion joins the first shield portion at an angle not more than about 35°.

6. The slat of claim 5 wherein the joining angle is about 25°.

7. The slat of claim 1 wherein the light processing material is comprised of a transparent or transluscent plastic.

8. The slat of claim 7 wherein the plastic is acrylic.

9. The slat of claim 1 wherein the opaque material is a plastic or a metal.

10. The slat of claim 9 wherein the opaque material is aluminium.

* * * * *